United States Patent [19]

Leung

[11] Patent Number: 4,689,196

[45] Date of Patent: Aug. 25, 1987

[54] SILVER-TUNGSTEN CARBIDE-GRAPHITE ELECTRICAL CONTACT

[75] Inventor: Chi H. Leung, Reidsville, N.C.

[73] Assignee: GTE Products Corporation, Stamford, Conn.

[21] Appl. No.: 19,284

[22] Filed: Feb. 26, 1987

Related U.S. Application Data

[62] Division of Ser. No. 748,251, Jun. 24, 1985.

[51] Int. Cl.[4] ..... B22F 1/00

[52] U.S. Cl. ..... 419/11; 75/240; 252/503; 252/504; 252/506; 252/514; 252/516; 252/518; 264/60; 264/125; 264/332; 419/18; 419/23; 419/31; 419/33

[58] Field of Search ..... 75/240; 264/125, 60, 264/332; 419/11, 23, 18, 31, 33; 252/504, 503, 506, 514, 516, 518

[56] References Cited

U.S. PATENT DOCUMENTS

| | | | |
|---|---|---|---|
| 3,865,586 | 2/1975 | Volin et al. | 419/18 |
| 4,139,374 | 2/1979 | Yih et al. | 419/18 |
| 4,153,755 | 5/1979 | Rothkegel et al. | 419/18 |

*Primary Examiner*—Stephen J. Lechert, Jr.
*Attorney, Agent, or Firm*—James Theodosopoulos

[57] ABSTRACT

An electrical contact comprises 5 to 20 weight percent tungsten carbide, 0.5 to 3 weight percent graphite, balance silver. The contact has low erosion rate, low contact resistance, and anti-welding properties.

7 Claims, No Drawings

SILVER-TUNGSTEN CARBIDE-GRAPHITE ELECTRICAL CONTACT

This application is a division of application Ser. No. 748,251, filed June 24, 1985.

This invention relates to electrical contacts. Such contacts generally comprise a highly conductive metal, usually silver. Examples are shown in U.S. Pat. Nos. 4,427,625, 4,361,033, 4,217,139 and 3,532,844. For high current applications, a refractory material is also often included. Examples are shown in U.S. Pat. Nos. 4,292,078, 4,153,755, 4,137,076, 4,088,480, 3,992,199, 3,951,872, 3,827,883, 3,686,456, 3,661,569, 3,482,950, 3,359,623, 3,225,169, 2,983,996, 2,978,641, 2,768,099, 2,706,759, 2,390,595 and 1,984,203. This invention is concerned with electrical contacts containing a refractory material.

Current limiting circuit breakers are now being designed for use with delicate electromagnetic and electronic circuits which rapidly detect over current conditions. These circuit breakers open very quickly, and a low resistance, low erosion and antiwelding contact is required. It is a purpose of this invention to provide such a contact.

An electrical contact in accordance with this invention comprises 5 to 20 weight percent tungsten carbide, 0.5 to 3 weight percent graphite, balance silver. The contact is a powder metal composite in which tungsten carbide particles are trapped inside silver aggregates. The graphite fills the space between boundaries. In order to obtain this composition, silver and tungsten carbide powders are mixed and presintered at an elevated temperature lower than usual sintering temperatures for powder metallurgy contacts, say, less than 800° C. Subsequently, the graphite is mixed in, and the material is pressed and sintered to form a densified compact which can be processed into an electrical contact.

In a specific example, a contact comprising silver, tungsten carbide and graphite in a weight ratio of 85 to 13 to 2 was made as follows.

A mixture of 85 grams of silver powder (2–5 microns) and 13 grams of tungsten carbide (1–3 microns) was mixed in a waring blender for one minute.

The mixture was presintered at 400°–500° C. in a tube furnace in an atmosphere of dissociated ammonia for 30 minutes.

The presintered powder mixture formed a porous cake which was crushed and sieved through a 45 mesh screen. The process resulted in tungsten carbide particles trapped inside silver aggregates.

The so prepared powder was then mixed with 2 grams of graphite powder (97% at minus 325 mesh) in a Waring blender for 15 seconds.

The result was 100 grams of flowable powder of contact material ready for pressing in a die.

Two processes were developed to consolidate the powder into an electrical contact, a press-sinter-repress method and a press-sinter-roll method.

In the press-sinter-repress method, a green part was pressed at about 6 tons per square inch to 7 gm/cm$^3$ (69% theoretical density) and then sintered in dissociated ammonia at 920°±10° C. for 30 minutes to a density of 7.9 gm/cm$^3$ (77.5% theoretical density) with about 3–4% linear shrinkage. The part was put back into the pressing die, coined at 35–45 tons per square inch to a minimum of 9.7 gm/cm$^3$ (95% theoretical density) and then resintered in dissociated ammonia at 920° C. for 30 minutes. The resulting contact had a hardness of $R_{15t}$ 42–53 and electrical conductivity of 55–63% IACS.

If the contact is to be brazed to a backing member, the sintered contact can be degraphitized at 750° C. for 3–5 minutes in air with brazing side facing up to create a thin (0.0005–0.005") graphite free layer for soldering.

In the press-sinter-roll method, the powder was pressed at 6 tons per square inch to form a small slab 1"×2"×0.16" thick having a density of 7.0 gm/cm$^3$. The slab was sintered at 920° C. in dissociated ammonia for 30 minutes. The resultant slab had a density of about 7.9 gm/cm$^3$, and could be progressively rolled to greater than 95% theoretical density, utilizing intermediate 15 minute anneals at 920° C. to facilitate rolling and to prevent cracking. The rolled slab could then be sheared, sawed or punched in a die, to a desired contact shape.

A second slab with a silver rich backing was also made by a double fillmethod in which a 3–5 micron silver powder formed the second layer (about 10% of the total slab thickness). The two layers are pressed together at 6 TSI and procesed identically.

Electrical tests at 30 amperes of 188 mil diameter contacts in accordance with this invention showed the material to have low contact resistance up to 8000 cycles, with erosion only about four to five times that of a 50% silver-50% tungsten contact, as shown in Table I. In Table I, the contact erosion is expressed as grams per operation times $10^{-6}$.

TABLE I

CONTACT EROSION IN SWITCHING TEST AT 30 AMP. 120 VAC.

| | | | Contact Erosion |
|---|---|---|---|
| Test 1 | Moving Contact | 50 Ag/50 W | 1.8 |
| | Stationary Contact | 50 Ag/50 W | 1.3 |
| | | Total = | 3.1 |
| Test 2 | Moving Contact | 50 Ag/50 W | 0.9 |
| | Stationary Contact | 85 Ag/13 WC/2 C | 5.9 |
| | | Total = | 6.8 |

In a high current evaluation at 1700 Amperes, erosion was only about double that of the silver-tungsten contact, as shown in table II. In Table II, the contact erosion is expressed as grams per operation times $10^{-3}$.

TABLE II

CONTACT EROSION IN HIGH CURRENT TEST AT 1700 AMP. 240 VAC.

| | | | Contact Erosion |
|---|---|---|---|
| Test 1 | Moving Contact | 50 Ag/50 W | 4.7 |
| | Stationary Contact | 50 Ag/50 W | 4.9 |
| | | Total = | 9.6 |
| Test 2 | Moving Contact | 85 Ag/13 WC/2 C | 14.6 |
| | Stationary Contact | 85 Ag/13 WC/2 C | 7.1 |
| | | Total = | 21.7 |

However the contact resistance of the contact of this invention is considerably superior to that of the silver-tungsten contact, as shown in Table III.

TABLE III

| | MILLIVOLT DROP | |
|---|---|---|
| Number of Operations | 50 Ag/50 W | 85 Ag/13 WC/2 C |
| 10 | 0 | 0 |
| 100 | 35 | 6 |

TABLE III-continued

| Number of Operations | MILLIVOLT DROP 50 Ag/50 W | 85 Ag/13 WC/2 C |
|---|---|---|
| 200 | 48 | 7 |
| 500 | 150 | 8 |
| 900 | 225 | 9 |
| 4800 | 325 | 10 |
| 7500 | 345 | 25 |
| 9500 | 360 | 25 |

Table III shows, for example, that after 4800 operations, the millivolt drop across the contact of this invention has increased to only 10 millivolts while that of the silver-tungsten contact has increased to 325 millivolts.

I claim:

1. In the method of making an electrical contact, the steps which comprise: mixing silver and tungsten carbide powders and then presintering the mixture at an elevated temperature less than 800° C.; crushing and sieving the presintered mixture; mixing graphite powder with the sieved mixture so as to form a flowable powder; and then pressing and sintering the flowable powder to form a densified compact which can be processed into an electrical contact.

2. The method of claim 1 where the mixture of silver and tungsten carbide powders is presintered at 400° to 500° C.

3. The method of claim 1 wherein the composition of the electrical contact is 5 to 20 weight percent tungsten carbide, 0.5 to 3 weight percent graphite, balance silver.

4. The method of claim 1 where the silver powder has a particle size of 2–5 microns and the tungsten powder has a particle size of 1–3 microns.

5. The method of claim 1 where the compact is sufficiently densified in order to be subsequently rolled to greater than 95% theoretical density.

6. The method of claim 1 including the step of pressing the flowable powder to obtain at least about 69% theoretical density and then sintering to increase to at least about 77.5% theoretical density and then coining to increase to at least about 95% theoretical density.

7. The method of claim 6 wherein one side of the coined contact is degraphitized to create a thin graphite free layer for brazing or soldering.

* * * * *